United States Patent [19]

Lechelle et al.

[11] Patent Number: 4,908,969

[45] Date of Patent: Mar. 20, 1990

[54] RETAINING DEVICE FOR THE CRANE OF A REVOLVER

[76] Inventors: Alain Lechelle, 58, rue du Docteur Mangeney, 68100 Mulhouse; Thierry Guidat, 2, rue Montherlant, 68200 Brunstatt; Serge Bruckert, 6, rue des Cèdres, 68700 Cernay, all of France

[21] Appl. No.: 313,379

[22] Filed: Feb. 21, 1989

[30] Foreign Application Priority Data

Feb. 26, 1988 [FR] France ..... 88 02400

[51] Int. Cl.[4] ..... F41C 25/10; F41C 1/02

[52] U.S. Cl. ..... 42/62

[58] Field of Search ..... 42/62

[56] References Cited

U.S. PATENT DOCUMENTS

| | | | |
|---|---|---|---|
| 279,197 | 6/1883 | Smith | 42/62 |
| 678,274 | 7/1901 | Owen | 42/62 |
| 975,685 | 11/1910 | Fyrberg | 42/62 |
| 1,518,027 | 12/1924 | Vosmek | 42/62 |
| 2,958,151 | 11/1960 | Sefried | 42/62 |

FOREIGN PATENT DOCUMENTS 2487062 7/1980 France .

*Primary Examiner*—Charles T. Jordan
*Assistant Examiner*—Michael J. Carone
*Attorney, Agent, or Firm*—Ladas & Parry

[57] ABSTRACT

The invention relates to a retaining device for retaining the crane of a revolver, said device being intended to provide longitudinal locking between the crane and the revolver crane while still allowing said crane to be released for dismantling purposes. According to the invention, a stopper (42) is slidably mounted inside the crane (3), said stopper having an end (44) projecting downwardly from the crane (3) in order to engage in an associated groove (47) provided in the frame (2) of the revolver. The stopper (42) is laterally accessible in part via an oblong slot (18) in the crane (3), thereby enabling said crane to be released by means of an elongate tool which retracts the end (44) of the sliding stopper (42). The invention is applicable to revolvers.

13 Claims, 6 Drawing Sheets

FIG_1
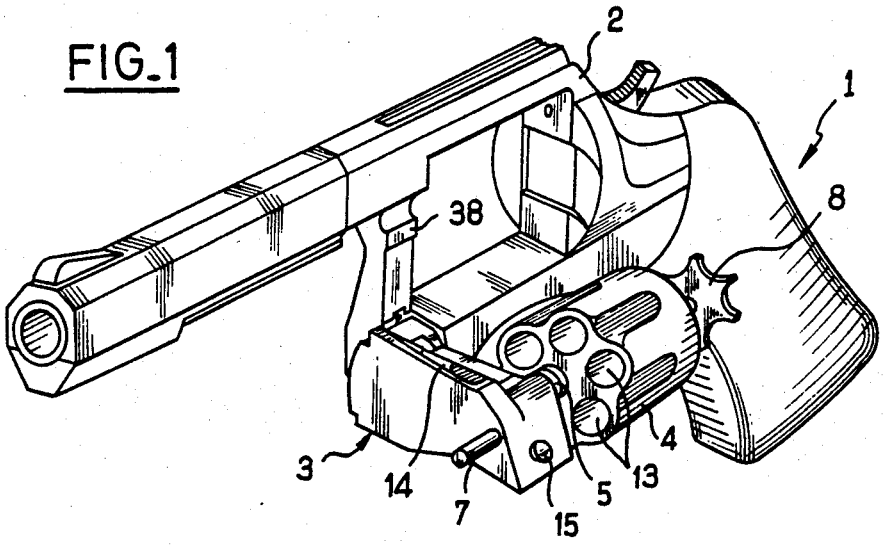
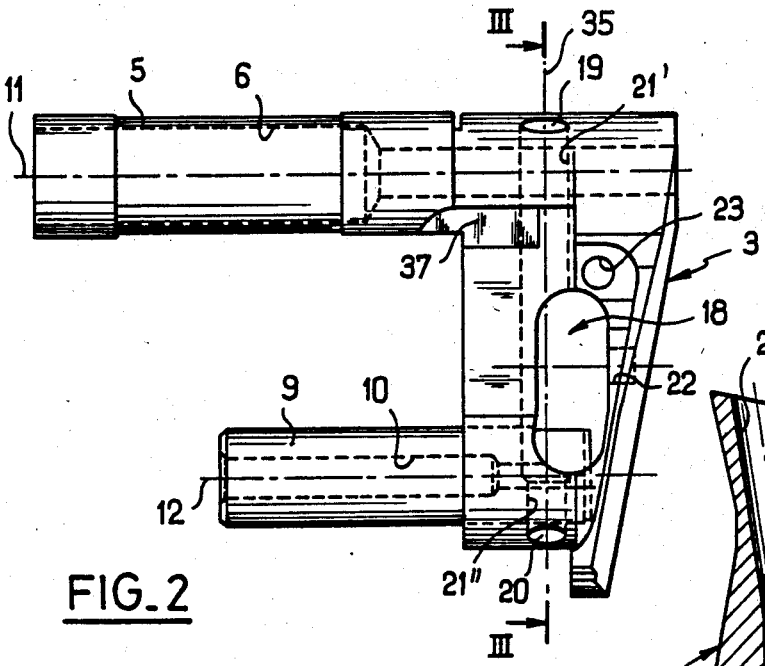
FIG_2
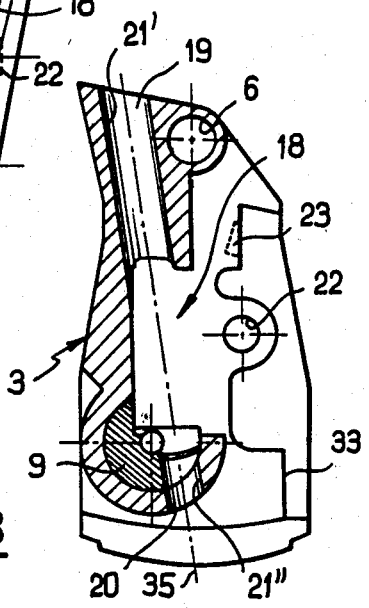
FIG_3

RETAINING DEVICE FOR THE CRANE OF A REVOLVER

The present invention relates to revolvers, and more particularly to their cranes.

BACKGROUND OF THE INVENTION

In accordance with a principle which is becoming more and more widespread, a revolver crane comprises a shaft pivotally mounted to the frame of the revolver and capable of swinging parallel to the axis of the barrel between a closed position in which the axis of the cylinder lies in the plane of symmetry of the revolver, and an open position in which he chambers of said cylinder are disengaged for loading or ejecting ammunition.

The invention relates more particularly to the problem of retaining the crane when it is no longer in the closed position, with such retention being necessary to prevent the crane together with the cylinder it carries from escaping forwardly by virtue of the crane shaft sliding in the associated housing provided in the frame of the revolver.

Numerous solutions have already been proposed for solving this problem, and typical retaining devices for performing this function are recalled briefly below.

The most traditional solution used for retaining the crane axially consists in machining a circular groove in the vicinity of the free end of the crane shaft, with an add-on member then being provided to penetrate into the groove and retain the crane without preventing it from pivoting.

The retaining member is frequently a transversely disposed dog point screw, with the end of this stop screw engaging in the circular groove, thereby providing a crane-retaining function.

This solution turns out to be not very satisfactory since the retaining screw can become loose; in addition it constitutes a visible part and a considerable amount of machining still needs to be done.

In a variant, the stop screw is replaced by a tab moveable transversely to the axis of the crane, said tab being mounted to rock or to slide, and being subjected to tab action of a spring for keeping it in position. Such a system is illustrated, for example, in French patent number 2 487 062. This naturally suffers from the same drawbacks as the preceding system.

In other revolvers, a removeable trigger guard assembly is provided including a portion of the trigger mechanism. In this case, the tenon of the trigger guard is used for acting as the retaining member with the end of said tenon engaging in a circular groove (of trapezoidal cross-section) machined near the free end of the crane shaft.

This solution suffers from major drawbacks, of which the most important is the complication involved with the operation of dismantling the crane, since the trigger guard must necessarily also be dismantled.

Proposals have also been made for revolvers having barrels with threaded ends and surrounded by respective sleeves (for a revolver having interchangeable barrels with associated sleeves), whereby the rear portion of each sleeve is extended downwardly: this serves to define a thrust face such that there is always a portion thereof making contact with the front face of the crane. This system suffers from the drawback of requiring a special sleeve with a rear face that must be machined to within close tolerances. In addition, whenever the crane needs to be dismantled, it is naturally necessary to remove the sleeve first.

Other prior systems may also be mentioned to complete the state of the art.

U.S. Pat. No. 2 958 151 describes a revolver whose crane is removeable sideways by pushing in a stud acting as a pivot pin for the crane. U.S. Pat. No. 975 685 describes a rotary stopper mounted at the rear of the barrel and coaxially thereabout, with one of the two angular positions of said stopper allowing the crane shaft to be released. U.S. Pat. No. 678 274 describes a revolver in which the crane shaft is prevented from rotating, with the crane being retained longitudinally by the head of a screw mounted at the end of said shaft.

Finally, mention may also be made of prior art systems in which there is no stopper associated with the crane, as illustrated by U.S. Pat. No. 1 518 027.

The object of the invention is to provide a crane retaining device which is more effective than the prior art devices described above, which is simpler in structure and cheaper to obtain, and which allows the crane to be dismantled easily without interfering with the axis of the cylinder being accurately positioned when the crane is in the closed position.

SUMMARY OF THE INVENTION

The present invention provides a retaining device for retaining the crane of a revolver, said crane including a shaft rotatably mounted on the frame of the revolver and being capable of swinging parallel to the axis of the barrel between a closed position in which the axis of the cylinder lies in the plane of symmetry of the revolver and an open position in which the chambers of said cylinder are disengaged for loading or ejecting ammunition, said retaining device serving to lock the crane longitudinally while enabling said crane to be released for the purpose of disconnecting it from the frame of the revolver, the retaining device comprises a stopper slidably mounted in the crane, said stopper having an end projecting from the bottom of the crane in order to engage in an associated groove provided in said frame, and being partially accessible laterally via an oblong slot formed in the crane so as to enable said crane to be released by means of an elongate tool used to retract said end of the stopper out of said associated groove.

Preferably, the sliding stopper is received in a hole drilled in the crane and opening out through the bottom thereof, said hole being drilled through the unit assembly constituted by the crane and its shaft. In particular, the hole and the body of the sliding stopper are stepped longitudinally so as to allow only an end portion of said stopper to project therefrom, while avoiding any risk of the stopper escaping from its housing after the crane has been dismantled.

According to an advantageous feature, the sliding stopper is permanently subjected to the action of a spring tending to cause the end of said stopper to project from the crane.

Preferably, in this case, the spring associated with the sliding stopper is also received in the same hole in which said stopper slides, said spring being disposed to bear against the top end of the stopper. In particular, the sliding stopper is essentially cylindrical in shape, except for its top end which forms a tab accessible via the oblong slot in the crane in order to enable an elongate tool to unlock said crane.

Advantageously, the groove provided in the frame of tee revolver has a section such that its front face is conical, thereby tending to urge the crane against said frame under the action of the projecting bottom end of the sliding stopper, said end being preferably conical or hemispherical in shape; in particular, the groove is provided substantially over a semicircle in a plane extending perpendicularly to the plane of symmetry of the revolver. In a variant, the groove provided in the frame of the revolver has a cross-section whose front face is square and parallel to the sliding direction of the sliding stopper.

In another variant, the groove provided in the frame of the revolver has a cross-section whose front face is square, and the sliding direction of the stopper is inclined so as to tend to urge the crane against said frame by virtue of the action of the projecting bottom end of the sliding stopper, which end is preferably conical or hemispherical in shape.

In yet another variant, the groove provided on the frame of the revolver has a cross-section whose front and rear faces are square, and the sliding stopper is of the type having a split end in order to define two lips received in said groove and capable of being splayed apart by a control member, e.g. a dog point screw.

Finally, according to another preferred feature, the oblong slot in the crane is provided in the inside face thereof such that said crane can be unlocked only when in its open position.

BRIEF DESCRIPTION OF THE DRAWINGS

Embodiments of the invention are described by way of example with reference to the accompanying drawings, in which:

FIG. 1 is a perspective view of a revolver fitted with a crane locking device in accordance with the invention, with the crane being shown in its open position;

FIG. 2 is an elevation view of the crane showing its shaft but without the moving parts which are fitted thereto such as the unlocking pushbutton, the sliding latch and stopper;

FIG. 3 is a section on III—III of FIG. 2 for more clearly distinguishing the inclined drilled hole passing from top to bottom through the crane, said hole being intended to receive a sliding latch and a sliding stopper;

Figure 6B:
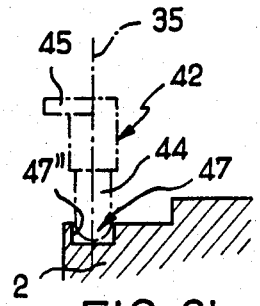
FIG. 6 is a perspective view of the sliding stopper normally mounted in the crane.
Figure 6:
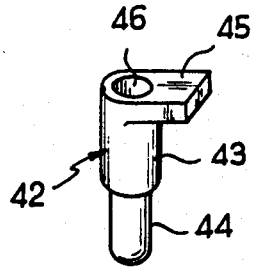
Figure 6A:
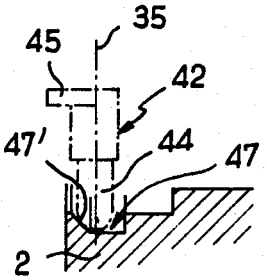
Figure 7:
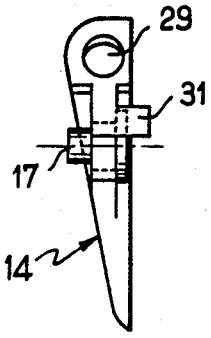
Figure 8:
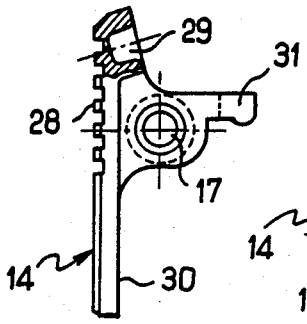
Figure 9:
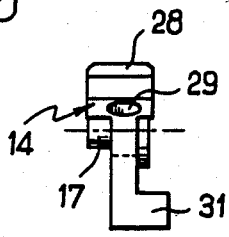
Figure 10:
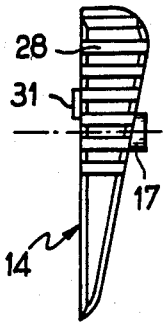
Figure 11:
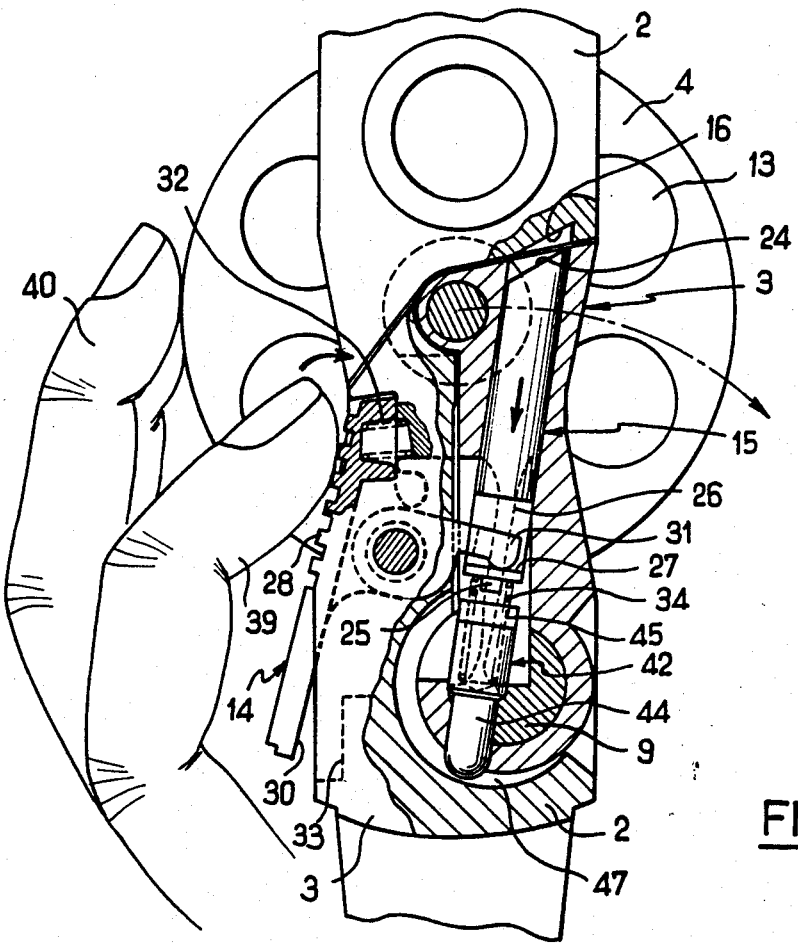
Figure 13:
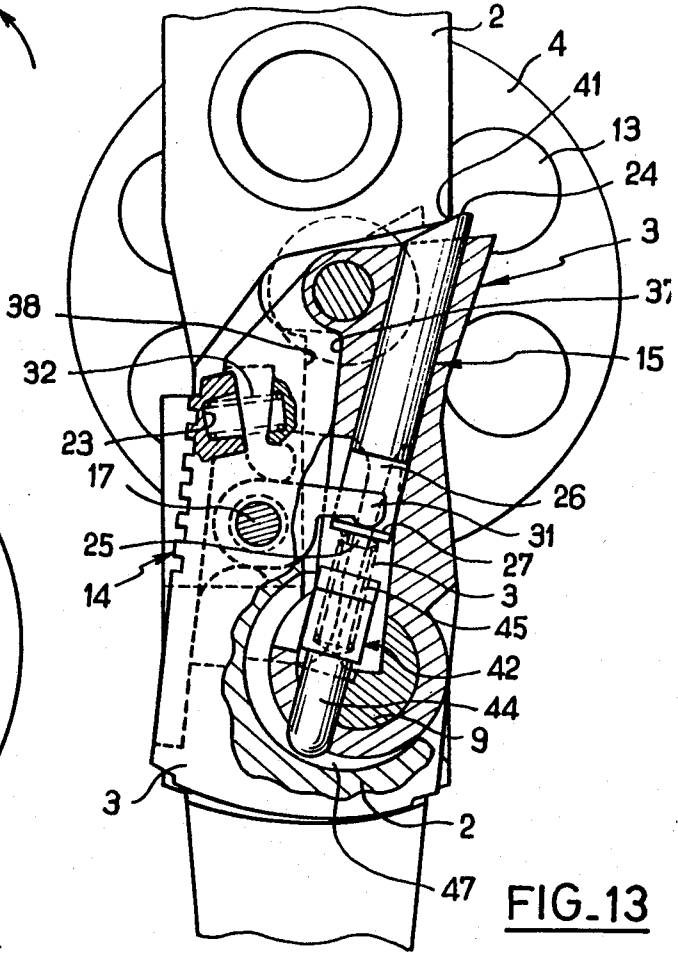
Figure 12:
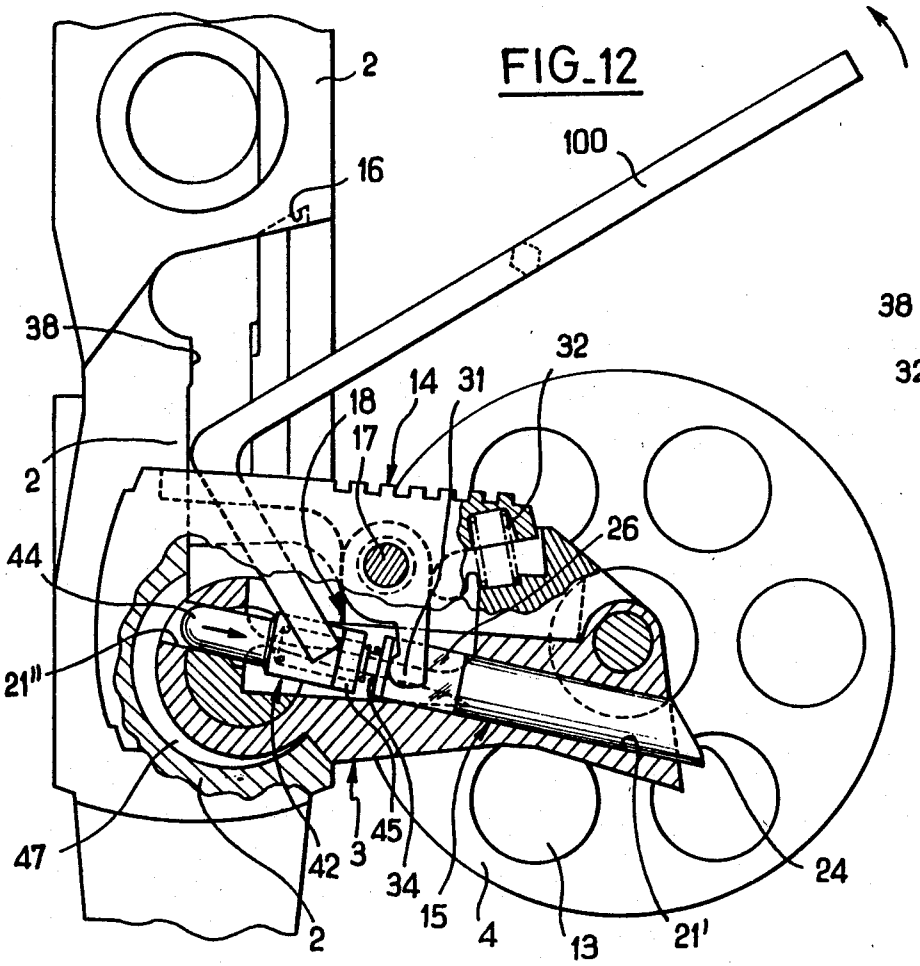
Figure 14:
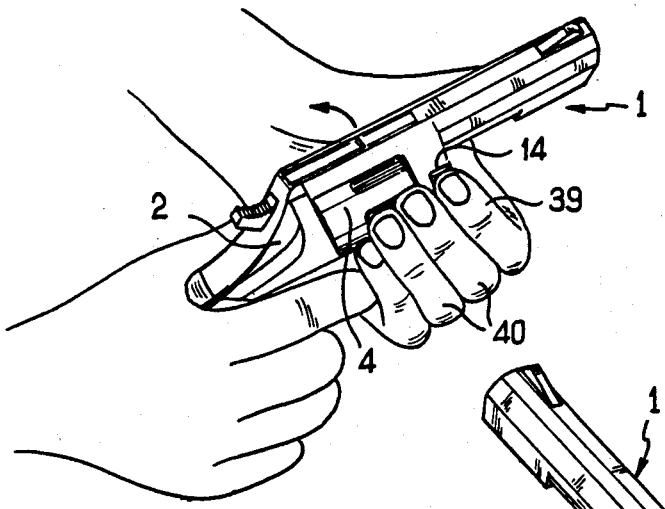
Figure 15:
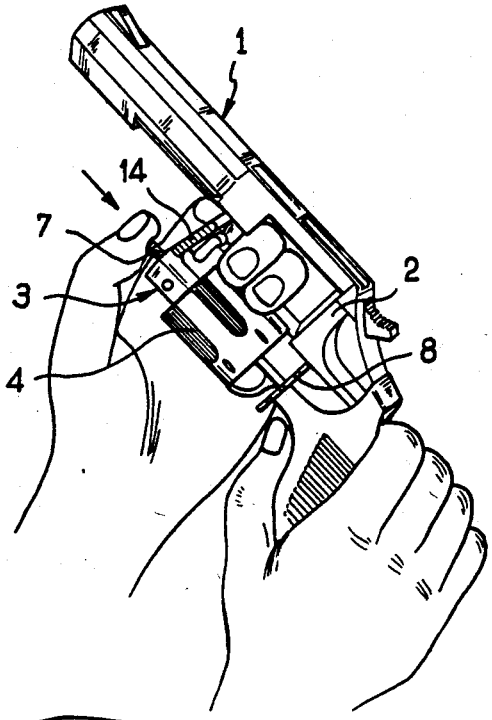
Figure 16:
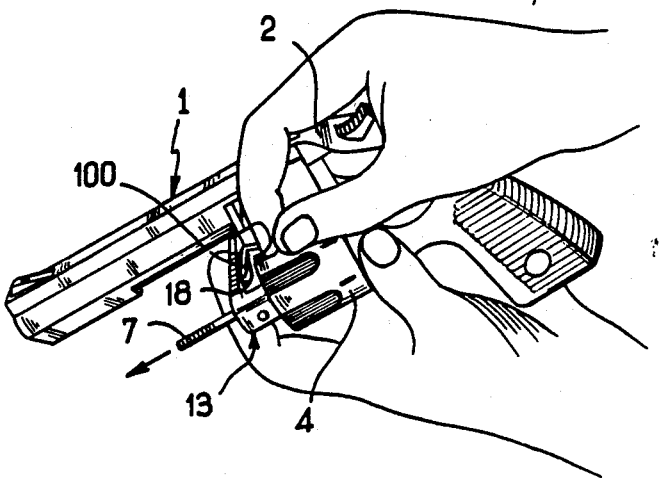
Figure 17:
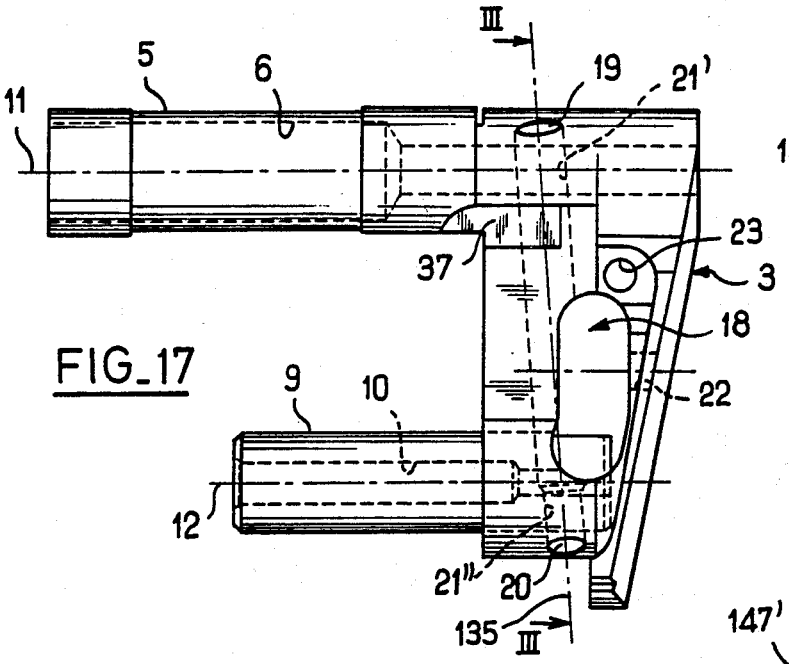
Figure 18:
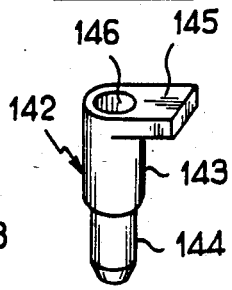
Figure 19:
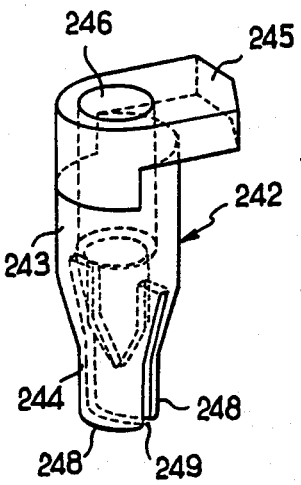

FIG. **6*a* is a detail in diagrammatic section showing a groove provided in the frame of the revolver for receiving the bottom end of the FIG. 6** stopper, said groove having a conical front face;

FIG. **6*b*** is a detail showing a variant of the above disposition in which the groove has a square front face, extending parallel to the sliding direction of the stopper;

FIGS. 7 to 10 are views showing the structure of the unlocking pushbutton having its pin fitted therein;

FIG. 11 is a cross-section through the revolver showing its crane still in its closed position, but with the end of its sliding latch retracted due to the associated pushbutton being actuated;

FIG. 12 is a section analogous to FIG. 11 showing the crane in the open position, said FIG. also showing an elongate tool for retracting the stopper of the crane for the purpose of removing the crane from the frame (with the crane then being moved longitudinally, i.e. perpendicularly to the plane of the figure);

FIG. 13 is a section analogous to FIG. 11, showing an intermediate position of the crane, in which the free end of the sliding latch is shown encountering an edge on the frame of the revolver while the crane is being closed;

FIG. 14 is a perspective view showing the particularly ergonomic nature of the invention whereby the crane may be unlocked using one hand pressing simultaneously against the pushbutton and against the cylinder;

FIG. 15 is a perspective view following FIG. 14 showing the crane in its fully open position and also showing how the thumb of the hand with which the pivot was unlocked is naturally level with the ejector rod so that ammunition can be quickly ejected;

FIG. 16 is a perspective view following FIG. 15 showing how the crane can be removed using an elongate tool for retracting the sliding stopper from the associated groove;

FIG. 17 is an elevation view of the crane and its shaft, analogous to FIG. 2, but showing a variant in which the axis of the drilled hole for receiving the sliding latch and the sliding stopper is inclined, thereby ensuring that the stopper mounted in the crane occupies an oblique position (with the section line III—III being retained, since FIG. 3 is substantially unaltered);

FIG. 18 is a variant of FIG. 6 showing a stopper with a frustoconical head;

FIG. **18*a* is a detail analogous to FIG. 6*a*** showing an oblique stopper having a frustoconical head which cooperates with the front face of the groove, with said front face then being square in this particular variant;

FIG. 19 is a perspective view of another variant sliding stopper of the type having a split end in order to define two lips which can be splayed apart by a control member, e.g. dog point screw (not shown), which is received in the tapped bore of said stopper); and FIGS. **20*a* and 20*b* are detail sections showing the relative positions between the FIG. 19** stopper and its associated groove, with the lips being shown respectively in the close together position and in the splayed apart position.

MORE DETAILED DESCRIPTION

FIG. 1 shows a revolver 1 including a frame 2 having a crane 3 mounted thereon and supporting a cylinder 4. The revolver barrel is permanently fixed to the frame in this case, but that is not any kind of limitation on the present invention.

As can be seen in FIG. 2, the crane 3 comprises a cylinder shaft 5 with a stepped bore 6 for receiving an ejector rod 7 and its associated spring (not shown) in conventional manner, with the rod 7 terminating, at the back of the cylinder in the form of a star-shaped member 8. The crane 3 also includes a pivot shaft 9 having a stepped bore 10. The two main axes 11 and 12 of the crane are parallel, and when the crane is mounted on the revolver frame, the axis 11 lies in the plane of symmetry of the gun. In conventional manner, the crane 3 can be tilted parallel to the axis of the barrel between a closed position in which the cylinder axis 11 lies in the plane of symmetry of the revolver 1, and an open position in which the chambers 13 of said cylinder 4 are disengaged for loading or ejecting ammunition.

The revolver 1 includes a special locking device for holding the crane 3 in its closed position.

Figure 4:
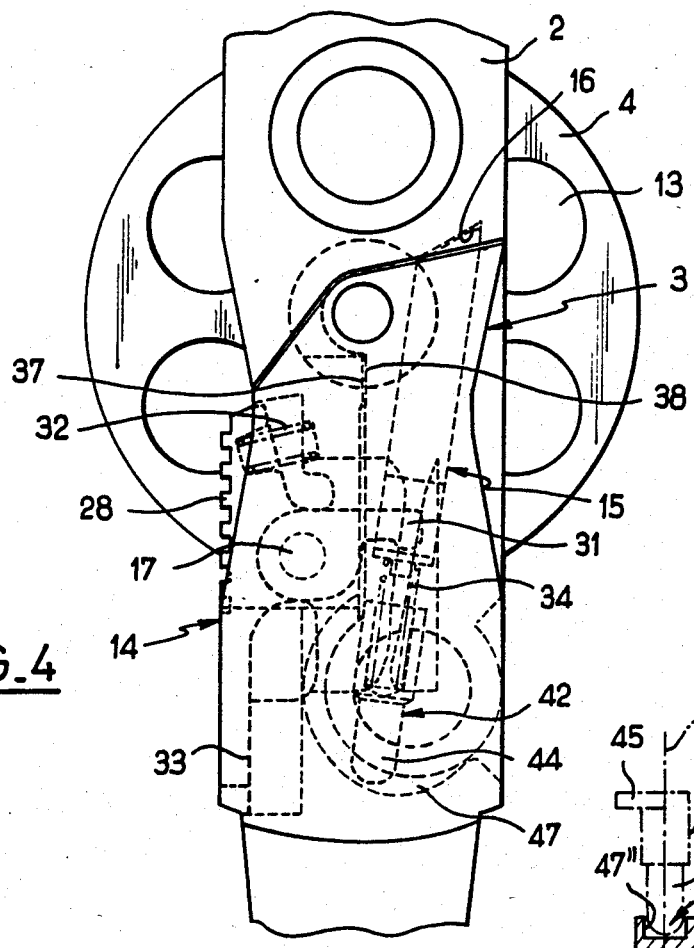
FIG. 4 is a fragmentary end view of the FIG. 1 revolver, showing its crane locked in the closed position.
Figure 5:
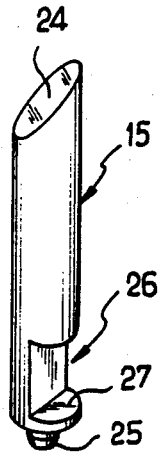
FIG. 5 is a perspective view of the sliding latch normally mounted in the crane, said latch constituting one of the essential means of the locking device of the present invention.

The locking device essentially comprises a pushbutton 14 whose special structure can be better understood with reference to FIGS. 7 to 10, and a sliding latch 15 whose structure is more particularly visible in FIG. 5. According to a characteristic aspect of this locking device, the pushbutton 14 and the sliding latch 15 are mounted on the crane 3, with said pushbutton being laterally accessible from the side of the gun opposite to the side from which the cylinder 4 is swung out, said pushbutton co-operating directly with the sliding latch 15 in order to retract the end thereof which is normally received, when the crane 3 is in its closed position, in an associated notch 16 formed in the frame 2 of the revolver (see FIGS. 4 and 11, in particular), with the disposition of the pushbutton 14 making it possible to unlock the crane 3 using the same hand as is used for swinging out the cylinder 4.

The pushbutton could be slidably mounted, however a structure which is simpler and more reliable is obtained by providing a pushbutton such as the button 14 shown which, in this case, pivots about an pin 17 parallel to the axes of the crane and the cylinder.

Returning to FIG. 2 and the associated section of FIG. 3, it can be seen that a relatively complex hollow is formed inside the crane 3. An oblong slot 18 provides lateral access to the hollow in the crane 3, with said slot 18 being formed on the inside face of said crane so as to be masked when the crane is closed. Two through orifices can also be seen, one of them, 19, opening out in the top of the crane 3, and the other one of them, 20, opening out in the bottom of said crane. As can be seen in FIG. 3, the top opening 19 corresponds to a drilled hole 21' in which the latch 15 is slidably mounted. FIGS. 2 and 3 also show a blind hole 22 Whose axis runs parallel to the axes of the crane 3, with said hole serving to receive the pin defining the axis 17 of the unlocking pushbutton 14. In practice, the small diameter end of the pin 17 is crimped or glued in the blind hole 22 of the crane 3. There is also a blind depression 23 for receiving the end of a spring associated with the unlocking pushbutton 14, said spring being visible in FIGS. 4, 11, 12, and 13.

Both the sliding latch 15 and the associated drilled hole 21' are preferably cylindrical for ease of manufacture. As can be seen in FIG. 5, the latch 15 is in the form of a cylindrical rod having a sloping top end facette 24 and a bottom end cylindrical peg 25. The latch 15 also has a lateral notch 26 in its bottom half so as to define a shoulder 27 enabling the unlocking pushbutton 14 and the sliding latch 15 to co-operate.

With reference to FIGS. 7 to 10, it can be seen that the unlocking pushbutton 14 includes an external actuator portion 28 whose top end is preferably ribbed in order to facilitate actuating the pushbutton. On the inside, the top end of this actuator portion includes a blind hole 29 for receiving the other end of the above-mentioned spring, while the bottom end of said portion includes an abutment surface 30 which is normally pressed against the crane 3 by the action of said spring. The pushbutton 14 also includes an internal actuator lug 31 for co-operating with the shoulder 27 of the sliding latch 15. The lug 31 is disposed on the side of the pushbutton pin 17 opposite to the external actuator portion 28 of the pushbutton which is accessible for operating said pushbutton. As can be seen in FIGS. 4, 11, 12, and 13, the actuator lug 31 engages in the lateral notch 26 of the sliding latch 15, with said lug thus serving simultaneously to actuate the sliding latch 15 in order to unlock the crane 3, and also to retain said latch when the crane is in the open position. The unlocking pushbutton 14 is permanently subjected to the action of a spring 32 (already mentioned above) tending to hold it in a position such that its external actuator portion 28 projects slightly proud from the lateral face of the crane 3, as can be seen in FIG. 4. The pushbutton 14 is held by the associated spring 32 in abutment against the crane 3 via the inside face 30 of the external actuator portion 28 of said pushbutton bearing against an associated facette 33 of the crane 3.

The sliding latch 15 is permanently subjected to the action of a spring 34 urging it out from the crane 3. Since the sliding latch 15 is received in the hole 21' through the crane 3, the above-mentioned spring 34 is preferably also received in said hole, and is disposed beneath the bottom end of the latch 15, in particular on the bottom peg 25 thereof.

The axis 35 of the hole 21' (FIG. 3) slopes slightly relative to the plane of symmetry of the revolver 36 (FIG. 4) when the crane 3 is in its closed position. As a result, when the crane is in its closed position an accurate thrust contact is ensured between a reference facette 37 of the crane 3 (FIGS. 2 and 4) and an associated facette 38 on the revolver frame 2 (FIGS. 1 and 4), thereby ensuring that the cylinder-supporting shaft 5 is in the geometrically correct position relative to the barrel.

In FIG. 4, the crane 3 is in its closed position. In this position, the top end of the sliding latch 15 is engaged in the associated notch 16 in the frame, and accurate contact is established between the reference facettes 37 and 38 which are disposed, in this case, in the plane of symmetry 36 of the revolver. The sliding latch 15 is held in this position by the action of the spring 34. The unlocking pushbutton 14 is held in a non-projecting position by the action of the spring 32. It should be observed in FIG. 4 that operating clearance is preferably provided in this position between the actuator lug 31 of the pushbutton and the shoulder 27 of the sliding latch 15. Such operating clearance provides additional security in obtaining reliable crane locking since the lug on the unlocking pushbutton cannot oppose the action of the spring 34 when the crane is in the closed position.

When the user seeks to unlock the crane, it suffices to press against the unlocking pushbutton 14, thereby automatically retracting the top end of the sliding latch 15 from its associated notch 16. This action is illustrated in FIG. 11, where it can be seen that the index finger 39 of the user's hand presses against the unlocking pushbutton 14 while the other fingers 40 of the same hand are naturally in contact with the cylinder 4 of the revolver. This position is shown in perspective in FIG. 14. The highly ergonomic aspect of this revolver structure can clearly be seen in this figure, since the user can easily unlock the crane using the left hand with the fingers thereof coming naturally into a position which facilitates this operation, and with the force to be exerted on the unlocking pushbutton additionally extending in the same direction as the force exerted directly on the cylinder of the revolver. This is due, in particular, to the fact that the unlocking pushbutton is laterally accessible from the side opposite to the side from which the cylinder 4 is swung out, unlike in conventional revolvers. FIG. 15 shows the crane in its fully open position, and shows, in particular, that the thumb of the hand used for opening the crane comes naturally into position for pressing against the end of the ejector rod 7, so that the user can press against this rod easily in order to eject ammunition. All of the hand movements required for moving the cylinder of the revolver through an angle of about 90° are completely natural and ergonomic. The cylinder is easily put back into place by the user pressing against the cylinder with the left thumb, while the revolver continues to be held in the right hand. The crane 3 and the cylinder 4 are then raised until the top end of the sliding latch 15 comes into contact with the frame 2 of the revolver, to take up the position shown in FIG. 13. In this position, the inclined face 24 engages an edge 41 on the frame, thereby causing the sliding latch 15 to penetrate into its housing against the action of the spring 34 until the fully closed position is reached in which the end of the sliding latch can be received in the associated notch 16, thereby returning to the position shown in FIG. 4.

It should be observed that conventional solutions for solving the problem of locking the crane in position normally include a pushbutton providing both locking and safety functions simultaneously, thereby requiring very close tolerances. In contrast, in the above-described device, unlocking and security are provided by two separate parts, each performing one of these functions, thereby providing greater flexibility in the making of these parts.

The figures of the accompanying drawing also show an advantageous solution to the problem of retaining the crane in the revolver when it is no longer in the closed position. Such retention must always be provided in order to prevent the crane and the cylinder carried thereby from escaping forwardly by virtue of the shaft about which the crane pivots sliding out of its housing in the revolver frame.

To solve this technical problem, a stopper 42 is provided whose structure can more readily be understood on examining FIG. 6. The stopper comprises an essentially cylindrical body 43 extending downwardly in the form of a bottom end 44, and having a tab 45 projecting from its top end. A blind hole 46 can also be seen for receiving the end of a spring which permanently exerts a force on the stopper 42. The stopper 42 is slidably mounted in the crane 3, with its direction of sliding being defined by an axis 35 which may be square, i.e. it may lie in a plane perpendicular to the main axes of the crane (FIG. 2), or else it may be at a slight slope relative to said plane (axis 135 in the variant shown in FIG. 17). In addition, said pusher has its end 44 projecting from the bottom of the crane 3 in order to be engaged in an associated groove 47 formed in the frame 2 of the revolver (FIGS. 4, 11, 12, and 13), while being partially accessible laterally via the oblong slot 18 in the crane 3 in order to enable the crane to be dismantled by means of an elongate tool 100 which serves to retract said end of the stopper 42 from the associated groove (with the dismantling tool 100 being visible in FIG. 12, only).

The sliding stopper 42 is received, in this case, in a drilled hole 21'' in the crane 3 which opens out through the bottom thereof, as visible in FIG. 3. Indeed, it is preferable for the hole 21'' to pass through the unit assembly constituted by the crane 3 and its shaft 9. In practice, the shaft 9 is assembled first (preferably by being glued) and then the hole 21'' is machined. The hole 21'' and the body of the sliding stopper 42 are preferably stepped longitudinally so as to allow only a portion of the end 44 of said stopper to project therethrough, thereby avoiding any risk of the stopper 42 escaping from its housing after the crane 3 has been dismantled. As can be seen in FIG. 3, it is advantageous to ensure that the hole 21' for the sliding latch 15 and the hole 21'' for the sliding stopper 42 share a common axis 35, thereby considerably simplifying machining operations. The sliding stopper 42 is preferably permanently subjected to the action of a spring tending to cause the end 44 of the stopper to project out from the crane 3. In particular, the above-mentioned spring may be received in the hole in which the sliding stopper 42 slides, in which case the spring is disposed to press against the top end of the stopper. It is then extremely advantageous to cause the spring 34 to act not only against the sliding latch 15, but also against the sliding stopper 42, as can be seen in FIGS. 4, 11, 12, and 13.

Thus, at all possible angular positions of the crane 3 between its closed position shown in FIG. 4 and its fully open position shown in FIG. 12, the end 44 of the sliding stopper 42 is received in the associated groove 47, and it is permanently thrust into the groove by the spring 34, thereby automatically ensuring that the crane 3 is retained even when it is no longer in the closed position.

Preferably, as shown in FIG. 6*a*, the groove 47 formed in the frame 2 of the revolver has a section such that its front face 47' is conical, thereby tending to press the crane 3 against said frame by virtue of the combined effect of the spring 34 and the projecting bottom end 44 of the sliding stopper 42. It is then advantageous to provide for said projecting end 44 to be substantially conical or hemispherical in shape so as to co-operate appropriately with the front portion 47' of the groove associated with the sliding stopper. The groove 47 extends substantially over a semicircle in a plane perpendicular to the plane of symmetry of the revolver 36. Naturally, this is merely an example, and it would be equally possible to provide a groove 47 whose front face 47'' is square and parallel to the sliding direction of the sliding stopper 42, i.e., in this case, perpendicular to the pivot axis of the crane, as shown in FIG. 6*b*.

Figure 18A:
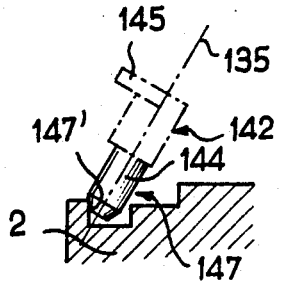

In a variant, it is possible to provide an oblique sliding stopper with a hemispherical or frustoconical head that cooperates with a groove whose front face is square. The obliqueness of the stopper is obtained by providing a drilled hole which is inclined relative to the crane, as shown in FIG. 17. The axis 135 of the drilled hole is slightly inclined, e.g. through an angle of about 8°, with said inclination corresponding to a bottom orifice which is in front of the top orifice (with the other references remaining unchanged in order to avoid excessively complicating the description). The associated groove 147 in the frame 2 then has a front face 147' which is square (FIG. 18*a*). The stopper used may be the same as that shown in FIG. 6 (having a hemispherical head), or it may be a stopper having a frustoconical head as shown in FIG. 18. The sliding stopper 142 has an essentially a cylindrical body 143 which extends downwardly in the form of a bottom end 144 constituting the frustoconical head, and which has a tab 145 projecting from its top end, together with a blind hole 146 for receiving a portion of the associated spring. Such an oblique pusher can give improved results firstly for providing a firm abutment opposing longitudinal displacement of the cylinder and crane assembly in the firing direction along the barrel, and secondly for taking up any slack between the end of the stopper and the front face of the associated groove.

Figure 20A:
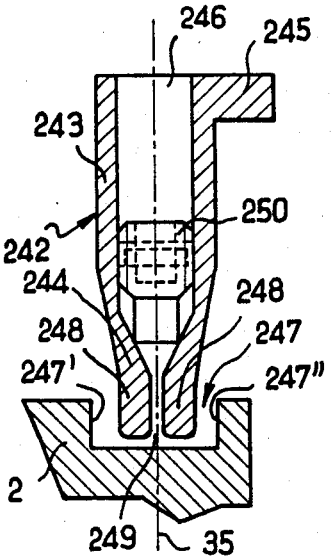
Figure 20B:
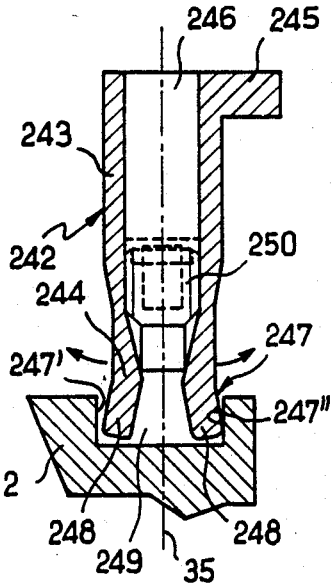

The above solution can be further improved while avoiding the need for a long strobe for the stopper relative to the possible depth of groove (about 8 mm for 2 mm). The stopper 242 shown in FIGS. 19, 20*a*, and 20*b* provides an advantageous solution. This stopper comprises an essentially cylindrical body 243 whose bottom end is split to provide two lips 248, on either side of a central (axial) slit 249. There is still a tab 245, but the central bore 246 is at least partially tapped in order to receive a dog point screw 250 (see FIGS. 20*a* and 20*b*). During assembly, the lips 248 of the sliding stopper 242 penetrate into the groove 247 of the frame 2, with the groove having square front and rear faces 247' and 247" respectively and with the lips 248 still being close together (position shown in FIG. 20*a*). Thereafter, the screw 250 is tightened so as to splay apart the lips 248 (position shown in FIG. 20*b*). This solution makes it possible to provide the above-mentioned firm abutment and take up of slack merely by adjusting the spacing between the lips of the stopper in the groove (without the stopper moving axially).

As mentioned above, the top end of the sliding stopper 42 (or 142, or 242) forming a tab 45 (or 145, or 245) is accessible via the oblong slot 18 in the crane 3 for the purpose of dismantling said crane by means of an elongate tool 100. This operation is shown in FIG. 12 which shows an elongate tool 100 such as an Allen key. As can be seen in FIG. 12, the operator inserts the short end of the tool through the oblong slot 18 so that its tip comes into contact with the tab 45 of the sliding stopper 42, while the bend in the tool bears against the frame of the revolver. It can then easily be understood that the sliding stopper 42 can be raised by raising the elongate tool 100, thereby disengaging the end 44 of the stopper from the groove 47, and thus releasing the crane 3. FIG. 16 is a perspective view showing this operation, and it shows the particularly ergonomic nature of the arrangement by virtue of the natural position of the left hand of the user whose thumb is ready to push the cylinder and crane assembly forwardly for the purpose of removing it. The crane is naturally reassembled by performing the operations in the reverse order: the cylinder and crane assembly is put into place initially until the projecting end 44 of the sliding stopper 42 comes into abutment against the frame, after which the elongate tool is used to retract said end and allow it to penetrate into the associated groove provided in the frame.

It will easily be understood that the cylinder and crane assembly remains intact after being removed from the frame and there is no danger of its moving parts escaping. The unlocking pushbutton is permanently fixed to the crane 3 by means of its pin, the sliding latch 15 is retained by the lug 31 of said unlocking pushbutton, and finally the sliding stopper 42 is retained by the shoulder in the stepped bore provided in the bottom portion of the crane. There is thus no danger of losing parts when the assembly is removed and handled.

It should be observed that the retaining device described above is much more satisfactory than prior devices and in particular than the prior solution which consists in machining a circular groove in the shaft of the crane and in engaging a stop screw in the groove. The permanent action of the spring 34 ensures that the crane is reliably held in place relative to the frame of the revolver. The structure of the retaining device is simple and cheap to obtain and the crane can nevertheless be removed easily and quickly.

The above description shows that the invention provides numerous advantages, by virtue of the small number of parts required, which parts also require only relatively easy tolerances, with the invention nevertheless providing handling operations which are both easy and ergonomic for unlocking the crane and/or for removing the crane and cylinder assembly.

The invention is not limited to the above-described embodiment, but extends to any variant using equivalent means to reproduce the essential characteristics of the claims.

We claim:

1. A revolver comprising: a retaining device for retaining a crane of a revolver, the crane supporting a cylinder and including a shaft rotatably mounted on a frame of the revolver for swinging parallel to an axis of a barrel of the revolver between a closed position in which the axis of the cylinder lies in the plane of symmetry of the revolver and an open position in which chambers of the cylinder are disengaged for loading or ejecting ammunition, the retaining device serving to lock the crane longitudinally while enabling the crane to be released for disconnecting it from a frame of the revolver; the retaining device also comprising a sliding stopper slidably mounted in a housing in the crane, the stopper having an end projecting from the bottom of the crane to engage in an associated groove provided in the frame and being partially accessible laterally via an oblong slot in the crane, whereby to enable the crane to be released by an elongated tool used to retract the end of the stopper out of the associated groove.

2. A revolver according to claim 1, wherein the sliding stopper is received in a hole in the crane and opening out through the bottom thereof.

3. A revolver according to claim 2, wherein the hole extends through a unit assembly comprising the

4. A revolver according to claim 3, wherein the hole and a body of the sliding stopper are stepped longitudinally for allowing only the end of the sliding stopper to project therefrom, whereby to avoid any risk of the sliding stopper escaping from its housing after the crane has been dismantled.

5. A revolver according to claim 1, wherein the sliding stopper is permanently subjected to the action of a spring tending to cause the end of said stopper to project from the crane.

6. A revolver according to claim 5, wherein the spring associated with the sliding stopper is also received in the same hole in which said stopper slides, said spring being disposed to bear against the top end of the stopper.

7. A revolver according to claim 6, wherein the sliding stopper is essentially cylindrical in shape, except for its top end which forms a tab accessible via the oblong slot in the crane in order to enable an elongate tool to unlock said crane.

8. A revolver according to claim 1, wherein the groove provided in the frame of the revolver has a section such that its front face is conical, whereby to tend to urge the crane against the frame under the action of the end of the sliding stopper, the end being one of conical and hemispherical in shape.

9. A revolver according to claim 1, wherein the groove provided in the frame of the revolver has a cross-section whose front face is square and parallel to the sliding direction of the sliding stopper.

10. A revolver according to claim 1, wherein the groove provided in the frame of the revolver has a cross-section with a square front face, and the sliding direction of the sliding stopper is inclined so as to tend to urge the crane against the frame by action of the end of the sliding stopper, the end being one of conical and hemispherical in shape.

11. A revolver according to claim 1, wherein the groove provided on the frame of the revolver has a cross-section with square front and rear faces, and the sliding stopper has a split end for defining two lips received in the groove, whereby to be capable of being splayed apart by a control member.

12. A device according to claim 8, wherein the groove is provided substantially over a semicircle, in a plane perpendicular to the plane of symmetry of the revolver.

13. A revolver according to claim 1, wherein the oblong slot in the crane is provided in the inside face thereof such that said crane can be unlocked only when in its open position.

* * * * *